US011546681B2

(12) United States Patent
Wang et al.

(10) Patent No.: US 11,546,681 B2
(45) Date of Patent: Jan. 3, 2023

(54) SPEAKER

(71) Applicant: Jabil Circuit (Singapore) Pte. Ltd., Singapore (SG)

(72) Inventors: Wen Hong Wang, Taichung (TW); Ching Feng Lin, Taichung (TW); Chia Chien Chen, Taichung (TW)

(73) Assignee: Jabil Circuit (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 17/477,950

(22) Filed: Sep. 17, 2021

(65) Prior Publication Data

US 2022/0141561 A1 May 5, 2022

(30) Foreign Application Priority Data

Nov. 4, 2020 (CN) ..... 202022525496.8

(51) Int. Cl.
*H04R 1/02* (2006.01)

(52) U.S. Cl.
CPC ..... *H04R 1/025* (2013.01)

(58) Field of Classification Search
CPC ..... H04R 1/025
USPC ..... 381/388
See application file for complete search history.

(56) References Cited

U.S. PATENT DOCUMENTS

| | | | | |
|---|---|---|---|---|
| 10,659,869 | B1 * | 5/2020 | Bobuk | G02B 27/0176 |
| 11,140,497 | B2 * | 10/2021 | Liao | H04R 25/606 |
| 2006/0203183 | A1 * | 9/2006 | Jannard | H04R 1/1066 351/41 |
| 2008/0112581 | A1 | 5/2008 | Kim et al. | |
| 2010/0329485 | A1 * | 12/2010 | Fukuda | H04R 25/00 381/151 |
| 2013/0051585 | A1 * | 2/2013 | Karkkainen | H04R 1/1075 381/151 |

* cited by examiner

*Primary Examiner* — Sean H Nguyen
(74) *Attorney, Agent, or Firm* — Young Basile Hanlon & MacFarlane, P.C.

(57) ABSTRACT

A speaker adapted to be disposed on a head-mounted device includes a housing member, a speaker unit, a vibrating unit and an abutting member. The housing member is adapted to be disposed on the head-mounted device and is formed with an opening adapted to open toward an ear of a user when in use. The speaker unit is disposed on the housing member in a manner that the speaker unit is not directly in contact with the head of the user when in use. The vibrating unit is disposed on the housing member and is capable of generating vibrations. The abutting member is disposed on the vibrating unit, is adapted to be in contact with the skin of the user, and is capable of transmitting the vibrations to the skull of the user.

16 Claims, 5 Drawing Sheets

SPEAKER

CROSS-REFERENCE TO RELATED APPLICATION

This application claims priority to Chinese Utility Model Patent Application No. 202022525496.8, filed on Nov. 4, 2020.

FIELD

The disclosure relates to a speaker, and more particularly to a speaker for a head-mounted device.

BACKGROUND

Head-mounted devices such as headsets, headphones or virtual reality headsets were generally equipped with speakers that might be divided into three types: over-ear; earbuds; and in-ear. All three types of the speakers are in direct contact with a user who wears the head-mounted device, and emit sound directly to the user's ear instead of emitting the sound in open air. However, for virtual reality headsets, the abovementioned speakers were less than ideal, because the speakers are in direct contact with the user's ears and may impair the user's immersion in virtual reality. Furthermore, the human auditory system may not be sensitive to sound with a frequency lower than 200 Hz, so a user may not perceive the low-frequency sound when the direct ear contact speakers emit both high-frequency and low-frequency sounds at the same volume level.

Therefore, to increase user immersion, a conventional speaker that emits sound in the open air, while simultaneously transmitting the low-frequency sound to the skull of a user via a vibrator has currently been adopted as the type of speaker used in head-mounted devices. By virtue of the conventional speaker emitting sound into the open air, the area of contact between a user and the conventional speaker is reduced. In addition, a user may better perceive the low-frequency sound by receiving vibrations conducted through the skull thereof. However, the conventional speaker also transmits some high-frequency sound via the vibrator as well, and the high-frequency sound may interfere with the user's perception of the low-frequency sound.

SUMMARY

Therefore, an object of the disclosure is to provide a speaker that can alleviate the drawback of the prior art.

According to an aspect of the disclosure, the speaker includes a housing member, a speaker unit, a vibrating unit and an abutting member. The housing member is adapted to be disposed on the head-mounted device and is formed with an opening that is adapted to open toward an ear of a user when in use. The speaker unit is disposed on the housing member in a manner where the speaker unit is not directly in contact with the head of the user when in use. The vibrating unit is disposed on the housing member and is capable of generating vibrations. The speaker unit is adapted to be closer to the ear of the user than the vibrating unit when in use. The abutting member is disposed on the vibrating unit, is adapted to be in contact with the skin of the user, and is capable of transmitting the vibrations to the skull of the user when in use, so that the user perceives sounds.

According to another aspect of the disclosure, the speaker includes a speaker unit, a vibrating unit and an abutting member. The speaker unit is adapted to be disposed on the head-mounted device. The vibrating unit is adapted to be disposed on the head-mounted device and is capable of generating low-frequency vibrations. The speaker unit is adapted to be closer to an ear of a user than the vibrating unit when in use. The abutting member is disposed on the vibrating member, and is adapted to be in contact with the skin of the user and to transmit the low-frequency vibrations to the skull of the user when in use, so that the user perceives low-frequency sound.

According to still another aspect of the disclosure, the speaker includes a housing member, a speaker unit and a vibrating unit. The housing member is formed with an opening. The speaker unit is disposed in the housing member and is capable of generating middle-frequency and high-frequency sounds that travel out from the speaker through the opening. The vibrating unit is disposed in the housing member and is capable of generating low-frequency sound through vibrations. The speaker unit is adapted to be closer to an ear of a user than the vibrating unit when in use.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
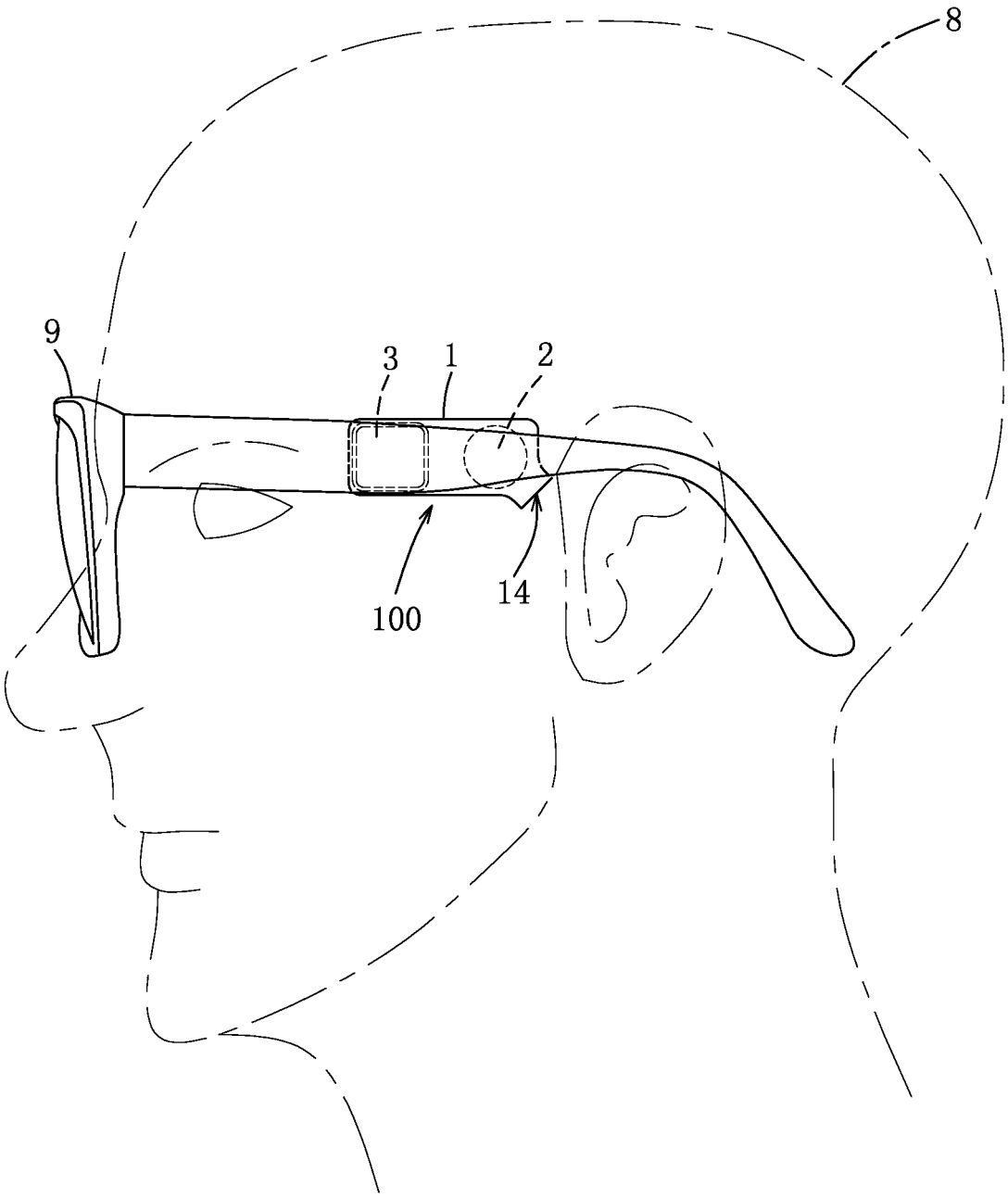
FIG. 1 is a side view of a head-mounted device mounted with an embodiment of a speaker according to the disclosure.
Figure 2:
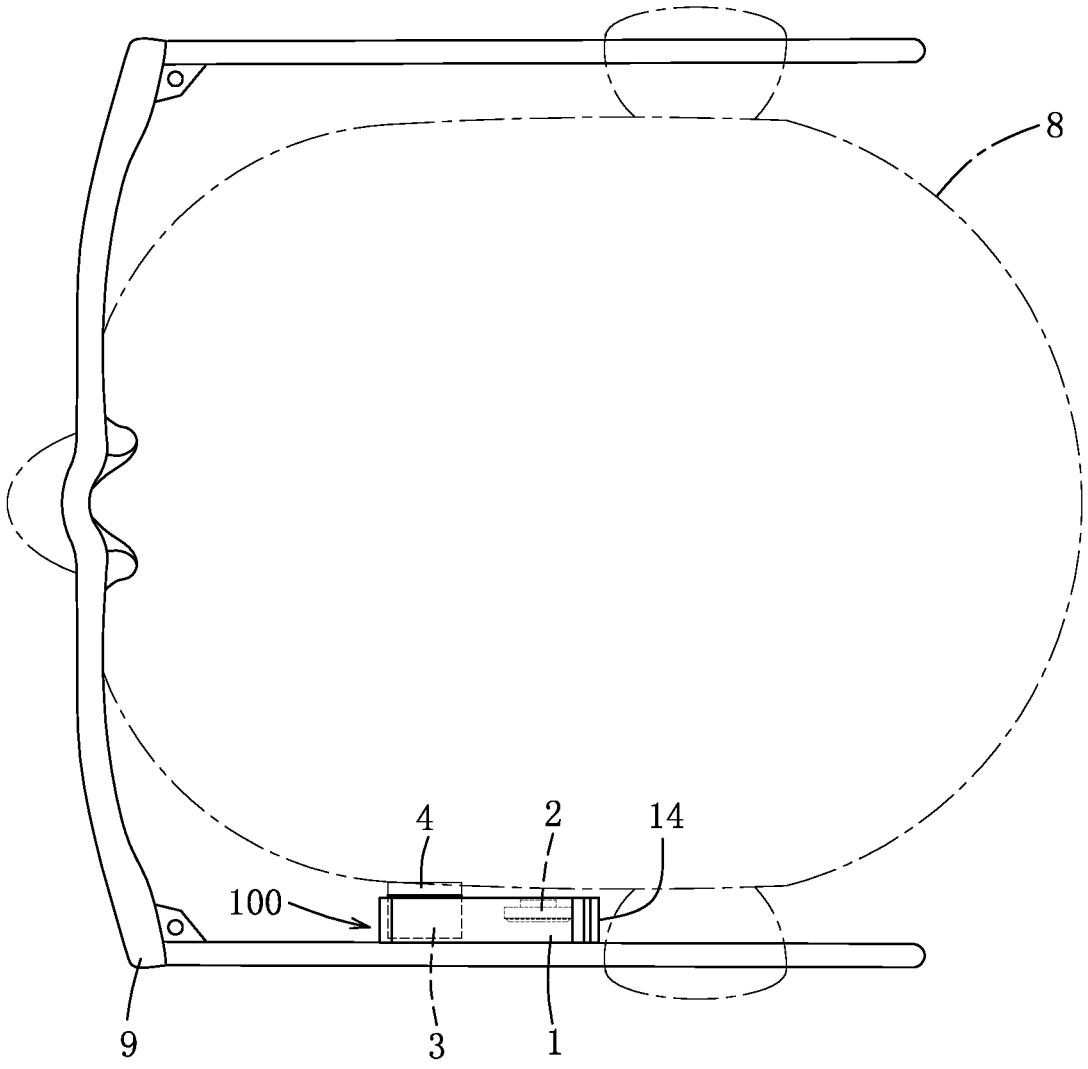
FIG. 2 is a top view of the head-mounted device mounted with the embodiment.
Figure 6:
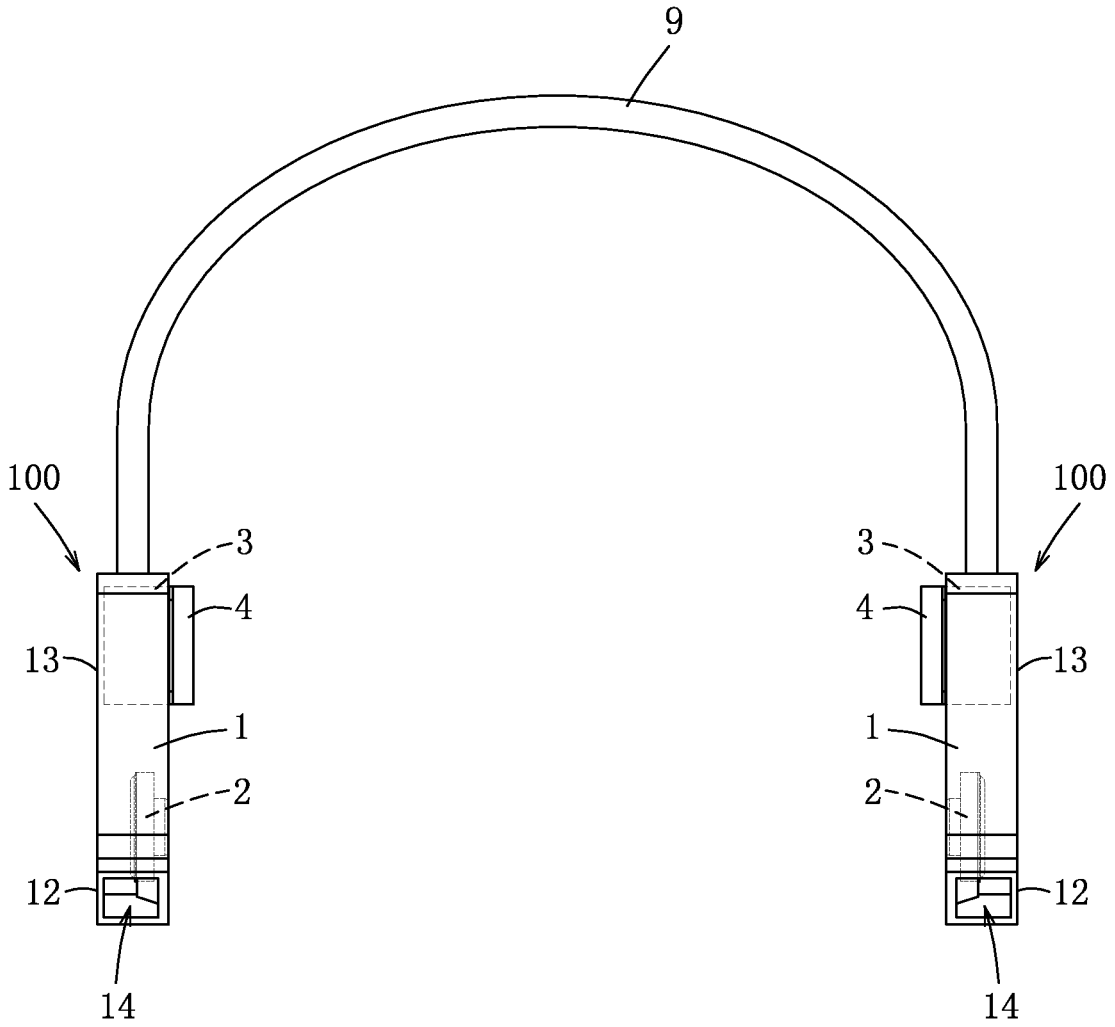
FIG. 6 is a front view of a head-mounted device having two ends each of which is mounted with the embodiment.

Referring to FIGS. 1, 2 and 6, an embodiment of a speaker 100 according to the disclosure is adapted to be disposed on a head-mounted device 9. The speaker 100 includes a housing member 1, a speaker unit 2, a vibrating unit 3 and an abutting member 4. The head-mounted device 9 may be an electronic device such as a smartphone, a pair of smart-glasses with a display system, or a headphone, and may be wearable via a strap, temples, or a headband. In this embodiment, the head-mounted device 9 is a pair of virtual reality glasses (FIGS. 1 and 2) that is wearable via temples thereof. The speaker 100 is disposed on one of the temples of the head-mounted device 9, and is close to an ear of a user 8 when the user 8 wears the head-mounted device 9. However, in other configurations, the head-mounted device 9 may be provided with two speakers 100 according to the disclosure (FIG. 6), so that a two-channel system is achieved.

Figure 3:
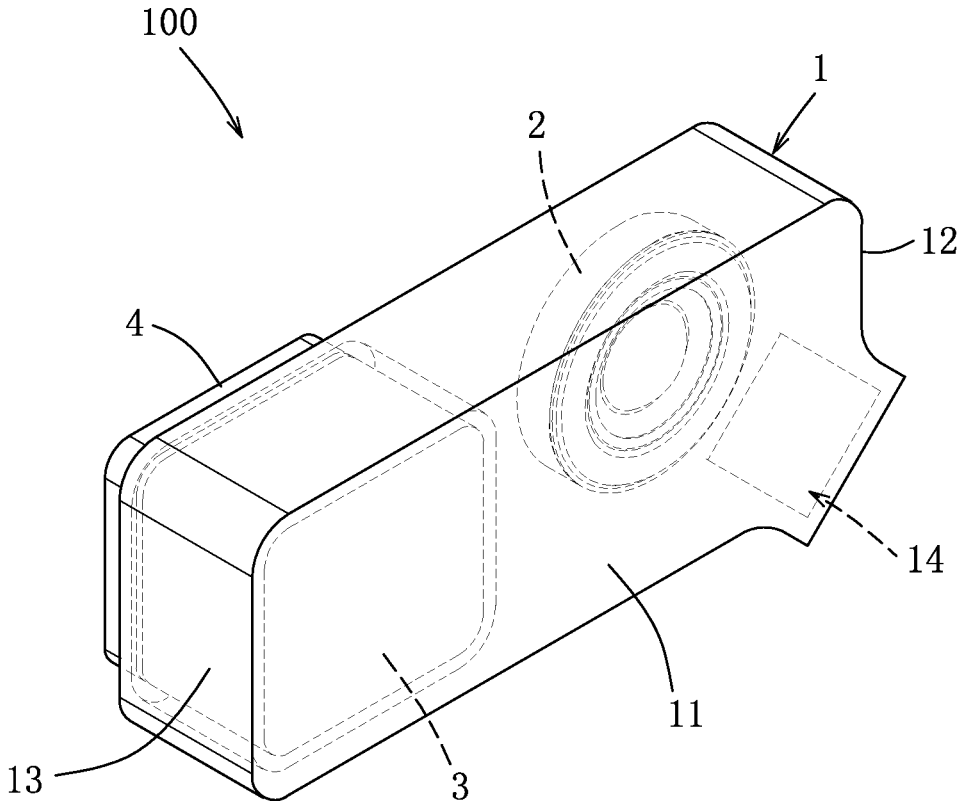
FIG. 3 is a perspective view of the embodiment.
Figure 4:
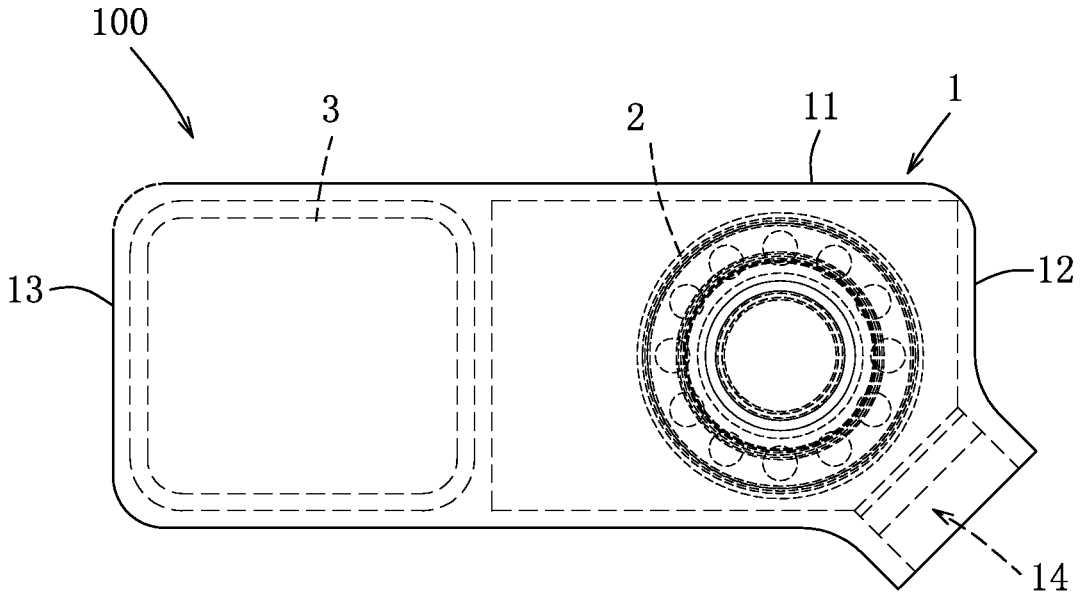
FIG. 4 is a side view of the embodiment.
Figure 5:
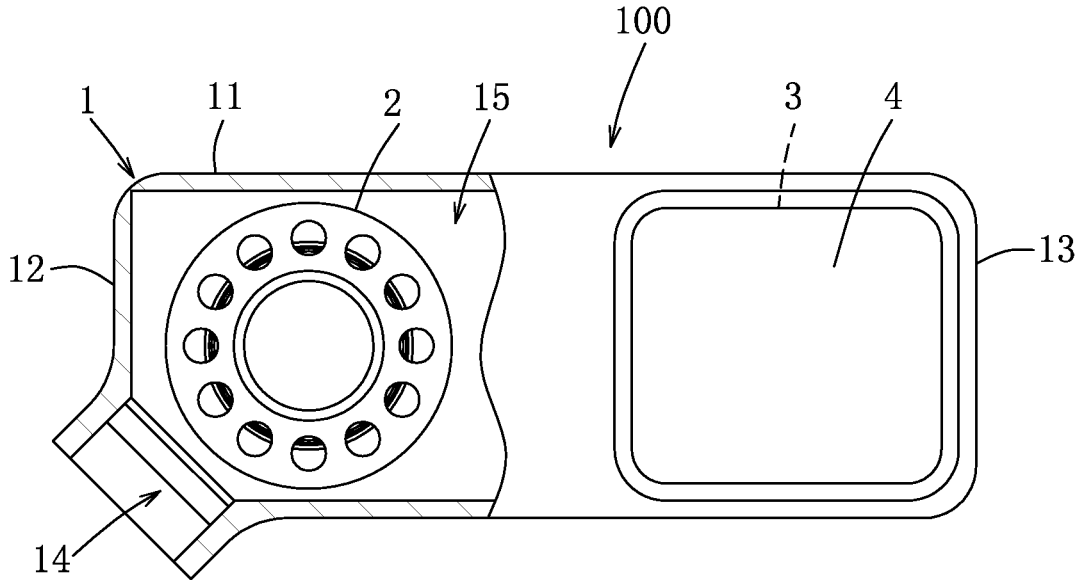
FIG. 5 is a fragmentary sectional view of the embodiment.

Referring further to FIGS. 3 to 5, the housing member 1 is adapted to be disposed on the head-mounted device 9, has a shell body 11, a first end 12 and a second end 13, and is formed with an opening 14 and a chamber space 15. In this embodiment, the housing member 1 is elongated and extends in a direction that is the same direction in which the one of the temples of the head-mounted device 9 extends. The first end 12 and the second end 13 are located at two opposite ends of the shell body 11. The first end 12 is closer to an ear of the user 8 than the second end 13 when in use. The opening 14 is formed at the shell body 11, and is located at the first end 12 so that the opening 14 is adapted to open toward the ear of the user 8 when in use. The second end 13 is a closed end. The chamber space 15 is formed in the shell body 11, is close to the first end 12, and communicates with the external environment through the opening 14.

The speaker unit 2 is disposed on the housing member 1 in a manner where the speaker unit 2 is not directly in contact with the head of the user 8 when in use, and is closer to the opening 14 than the vibrating unit 3. Specifically, the speaker unit 2 is disposed in the chamber space 15. The speaker unit 2 is capable of generating middle-frequency and high-frequency sounds. In this embodiment, the speaker unit 2 is a speaker driver that generates middle-frequency and high-frequency sounds in a frequency range, for example, ranging from 200 to 20,000 Hz. By virtue of the chamber space 15, the middle-frequency and high-frequency sounds generated by the speaker unit 2 are reflected by an inner surface of the shell body 11, and travel out from the speaker 100 into the open air only through the opening 14. The user 8 may then perceive the middle-frequency and high-frequency sounds since the opening 14 is adapted to open toward the ear of the user 8 when in use.

The vibrating unit 3 is disposed on the housing member 1, is capable of generating vibrations, and is close to the second end 13 of the housing member 1 so that the speaker unit 2 is adapted to be closer to the ear of the user 8 than the vibrating unit 3 when in use. In this configuration, the vibrating unit 3 and the speaker unit 2 are located between the ear and the eye on the same side of the user 8, and the vibrating unit 3 is located in front of the speaker unit 2 when in use. Therefore, the vibrations generated by the vibrating unit 3 may not interfere with the middle-frequency and high-frequency sounds generated by the speaker unit 2.

The abutting member 4 is disposed on the vibrating unit 3, and protrudes out of a surface of the housing member 1 that faces the user 8 to thereby be adapted to be in contact with the skin of the user 8 when in use. Specifically, the abutting member 4 is adapted to be located between the vibrating unit 3 and the head of the user 8 when in use. The abutting member 4 is made of a material that absorbs middle-frequency and high-frequency sounds. Therefore, the middle-frequency and high-frequency sounds that are generated by the speaker unit 2 in the open air are absorbed when traveling near the vibrating unit 3. In this embodiment, the abutting member 4 may be made of silicone, foamed plastic (e.g., polyurethanes), or a porous material. The vibrating unit 3 is a bone conduction transducer that generates low-frequency vibrations, and the low-frequency vibrations are transmitted to the skull of the user 8 by the abutting member 4 so that the user 8 perceives the low-frequency sound in a frequency range, for example, ranging from 20 to 200 Hz. In addition, by adjusting thickness of the abutting member 4, or by changing the material that the abutting member 4 is made of, the frequency range of the sounds that are absorbed by the abutting member 4 may change. Consequently, the frequency range of the low-frequency sound that is perceived by the user 8 is adjustable.

It is noted that, in this embodiment, only the abutting member 4 of the speaker 100 is adapted to be in contact with the user 8, which provides the user 8 with a better virtual reality experience when the user 8 wears the head-mounted device 9 (i.e., the pair of Virtual Reality glasses).

In the abovementioned configuration of this embodiment shown in FIG. 6, the head-mounted device 9 is wearable via a headband similar to that of a headphone. The speakers 100 are respectively disposed on two opposite ends of the head-mounted device 9 via, for example, the second ends 13 thereof. When the user 8 (not shown in FIG. 6) wears the head-mounted device 9, the speaker unit 2 of each of the speakers 100 is closer to a corresponding one of the ears of the user 8 than the vibrating unit 3 of the speaker 100. In this configuration, the vibrating unit 3 of each of the speakers 100 may be located above the speaker unit 2 when in use. Thus, this configuration shares the same characteristics as the embodiment shown in FIGS. 1 to 5, where the low-frequency vibrations generated by the vibrating units 3 may be prevented from interfering with the middle-frequency and high-frequency sounds generated by the speaker units 2 when the speakers 100 are in use.

It is noted that, in this embodiment, the housing member 1 is adhered to the head-mounted device 9. However, in other embodiments, the housing member 1 may be fastened to the head-mounted device 9 with a buckle or a clamp. The means of disposing the housing member 1 on the head-mounted device 9 is not limited.

In some embodiments, the housing member 1 may be omitted. That is to say, in an embodiment (not shown) in which the housing member 1 is omitted, each of the speaker unit 2, the vibrating unit 3 and the abutting member 4 may be adapted to be directly disposed on the head-mounted device 9. Specifically, the abutting member 4 is disposed on the head-mounted device 9, and on the vibrating unit 3 as well.

Still, in some embodiments, the abutting member 4 may be omitted. In an embodiment (not shown) in which the abutting member 4 is omitted, the speaker unit 2 is disposed in the housing member 1, and the vibrating unit 3 is capable of generating low-frequency sounds through vibrations and is farther from the ear of the user than the speaker unit 2. The speaker 100 may be adapted to be used with any suitable device.

In summary, by virtue of the chamber space 15 and the opening 14 of the housing member 1, and by virtue of the speaker unit 2 being adapted to be closer to the ear of the user 8 when in use, the middle-frequency and high-frequency sounds generated by the speaker unit 2 may be emitted into the open air and may be perceived by the user 8 without interference from the low-frequency vibrations generated by the vibrating unit 3. Moreover, by virtue of the abutting member 4 being disposed on the vibrating unit 3, and being adapted to be located between the head of the user 8 and the vibrating unit 3, the low-frequency sounds may be perceived by the user 8 through bone conduction, and the middle-frequency and the high-frequency sounds around the vibrating unit 3 may be absorbed by the abutting member 4. Therefore, the low-frequency sounds may be perceived by the user 8 without interference from the middle-frequency and high-frequency sounds generated by the speaker unit 2.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A speaker adapted to be disposed on a head-mounted device, said speaker comprising:

a housing member adapted to be disposed on the head-mounted device and formed with an opening that is adapted to open toward an ear of a user when in use;

a speaker unit disposed on said housing member in a manner where said speaker unit is not directly in contact with a head of the user when in use;

a vibrating unit disposed on said housing member and capable of generating vibrations, said speaker unit being adapted to be closer to the ear of the user than said vibrating unit when in use; and an abutting member disposed on said vibrating unit, adapted to be in contact with a skin of the user, and capable of transmitting the vibrations to a skull of the user when in use, so that the user perceives sounds;

wherein said abutting member is made of a material that absorbs middle-frequency and high-frequency sounds.

2. The speaker as claimed in claim 1, wherein said speaker unit is capable of generating middle-frequency and high-frequency sounds.

3. The speaker as claimed in claim 1, wherein the vibrations generated by said vibrating unit are low-frequency vibrations.

4. The speaker as claimed in claim 1, wherein said speaker unit is closer to said opening of said housing member than said vibrating unit.

5. The speaker as claimed in claim 1, wherein said housing member is elongated, and has a first end at which said opening is located, and a second end, said vibrating unit being close to said second end.

6. The speaker as claimed in claim 5, wherein said second end of said housing member is a closed end.

7. The speaker as claimed in claim 1, wherein said housing member is formed with a chamber space which communicates with the external environment through said opening, and in which said speaker unit is disposed.

8. The speaker as claimed in claim 1, wherein said abutting member protrudes out of a surface of said housing member that faces the user to thereby be adapted to be in contact with the skin of the user when in use.

9. A speaker adapted to be disposed on a head-mounted device, said speaker comprising:

a speaker unit adapted to be disposed on the head-mounted device;

a vibrating unit adapted to be disposed on the head-mounted device and capable of generating low-frequency vibrations, said speaker unit being adapted to be closer to an ear of a user than said vibrating unit when in use; and an abutting member disposed on said vibrating unit, and adapted to be in contact with a skin of the user and to transmit the low-frequency vibrations to a skull of the user when in use, so that the user perceives low-frequency sounds;

wherein said abutting member is made of a material that absorbs middle-frequency and high-frequency sounds.

10. The speaker as claimed in claim 9, wherein said speaker unit is capable of generating middle frequency and high-frequency sounds.

11. The speaker as claimed in claim 9, further comprising a housing member that is formed with an opening adapted to open toward the ear of the user when in use, said speaker unit being closer to said opening than said vibrating unit.

12. A speaker comprising:

a housing member formed with an opening;

a speaker unit disposed in said housing member and capable of generating middle-frequency and high-frequency sounds that travel out from said speaker through said opening;

a vibrating unit disposed on said housing member and capable of generating low-frequency sound through vibrations, said speaker unit being adapted to be closer to an ear of a user than said vibrating unit when in use; and an abutting member disposed on said vibrating unit, adapted to be in contact with a skin of the user, and capable of transmitting the vibrations to a skull of the user when in use, so that the user perceives the low-frequency sound generated by said vibrating unit;

wherein said abutting member is made of a material that absorbs middle-frequency and high-frequency sounds.

13. The speaker as claimed in claim 12, wherein said abutting member protrudes out of a surface of said housing member that faces the user to thereby be adapted to be in contact with the skin of the user when in use.

14. The speaker as claimed in claim 12, wherein said speaker unit is closer to said opening of said housing member than said vibrating unit.

15. The speaker as claimed in claim 12, wherein said housing member is elongated, and has a first end at which said opening is located, and a second end, said vibrating unit being close to said second end.

16. The speaker as claimed in claim 15, wherein said second end of said housing member is a closed end.

* * * * *